US010109965B2

(12) United States Patent
Taylor et al.

(10) Patent No.: US 10,109,965 B2
(45) Date of Patent: Oct. 23, 2018

(54) RADIO FREQUENCY CONNECTOR ASSEMBLY INCLUDING CONTACT RAMP SEGMENT HAVING A PROGRESSIVELY DECREASING DIAMETER DEFINING A CURVATURE AND RELATED METHODS

(71) Applicant: WINCHESTER INTERCONNECT HERMETICS, LLC, Melbourne, FL (US)

(72) Inventors: Edward A. Taylor, Melbourne, FL (US); James G. Petri, Melbourne, FL (US)

(73) Assignee: WINCHESTER INTERCONNECT HERMETICS, LLC, Melbourne, FL (US)

( * ) Notice: Subject to any disclaimer, the term of this patent is extended or adjusted under 35 U.S.C. 154(b) by 0 days.

(21) Appl. No.: 15/705,916

(22) Filed: Sep. 15, 2017

(65) Prior Publication Data

US 2018/0083398 A1 Mar. 22, 2018

Related U.S. Application Data

(60) Provisional application No. 62/397,128, filed on Sep. 20, 2016.

(51) Int. Cl.
*H01R 24/40* (2011.01)
*H01R 13/62* (2006.01)
(Continued)

(52) U.S. Cl.
CPC ..... *H01R 24/40* (2013.01); *H01R 13/62* (2013.01); *H01R 13/631* (2013.01); *H01R 24/542* (2013.01); *H01R 2101/00* (2013.01)

(58) Field of Classification Search
CPC .. H01R 2103/00; H01R 9/0521; H01R 24/40; H01R 24/50
(Continued)

(56) References Cited

U.S. PATENT DOCUMENTS

2014/0030915 A1* 1/2014 Perrin ..... H01R 24/50 439/578
2015/0072556 A1* 3/2015 Hirakawa ..... H01R 24/50 439/578

OTHER PUBLICATIONS

Department of Defense, United States of America, Department of Defense Interface Standard MIL-STD-348B Aug. 17, 2014 Superseding MIL-STD-348A Apr. 20, 1988 Radio Frequency Connector Interfaces for MIL-DTL-3643, MIL-DTL-3650, MIL-DTL-3655, MIL-DTL-25516, MIL-PRF-31031, MIL-PRF-39012, MIL-PRF-49142, MIL-PRF-55339, MIL-DTL-83517, AMSC N/A FSC 5935, May 18, 2016, 222 pages, available at http://quicksearch.dla.mil/qsDocDetails.aspx?ident_number=35726.

* cited by examiner

*Primary Examiner* — Gary Paumen
(74) *Attorney, Agent, or Firm* — Allen, Dyer, Doppelt + Gilchrist, P.A.

(57) ABSTRACT

A radio frequency connector assembly may include a first RF connector that includes a tubular electrically conductive body having a radially compressible end, and a second RF connector that includes an electrically conductive housing having a passageway therethrough. The passageway may define a throat segment having a constant diameter equal to or larger than the radially compressible end and a contact ramp segment adjacent the throat segment and configured to compress the radially compressible end. The contact ramp segment may have a progressively decreasing diameter defining a curvature. The passageway may also define a medial segment having a constant diameter equal to a
(Continued)

diameter of an adjacent portion of the contact ramp segment, and a capture segment adjacent the medial segment having a diameter larger than the medial segment. A dielectric body may be carried by the housing supporting an electrically conductive pin.

23 Claims, 6 Drawing Sheets

(51) Int. Cl.
*H01R 13/631* (2006.01)
*H01R 101/00* (2006.01)
*H01R 24/54* (2011.01)

(58) Field of Classification Search
USPC ..... 439/675, 578–585
See application file for complete search history.

RADIO FREQUENCY CONNECTOR ASSEMBLY INCLUDING CONTACT RAMP SEGMENT HAVING A PROGRESSIVELY DECREASING DIAMETER DEFINING A CURVATURE AND RELATED METHODS

RELATED APPLICATION

The present invention is related to U.S. Provisional Patent Application Ser. No. 62/397,128 filed Sep. 20, 2016, the entire contents of which are incorporated herein by reference.

TECHNICAL FIELD

The present invention relates to the field of electronic assemblies, and, more particularly, to radio frequency (RF) connector assemblies, and associated methods.

BACKGROUND

An RF connector assembly may include one or more RF connectors, for example, a male and female connector set. An RF connector is typically used as an interconnect between cables, components, and/or other RF connectors.

There are many different types of RF connectors. For example, an RF connector may be a threaded connector, a blind-mate connector, or a bayonet connector. An RF connector may also include braces and/or other types of fasteners or coupling mechanisms for mating with another RF connector.

Regardless of the type of RF connector, it may be desirable that the RF connector be relatively easy to mate and be capable of withstanding a large number of mating cycles. For example, it may be desirable to reduce insertion force, yet maintain the integrity of the electrical connection between RF connectors.

Additionally, it may be desirable for an RF connector to exhibit little, if any, impedance change at the RF connector interface, for example, an interface with another RF connector. Signal attenuation may also be undesirable, for example, that may occur from improper or loose fitment of mating RF connectors, vibration, and/or foreign debris.

SUMMARY

A radio frequency (RF) connector assembly may include a first RF connector including a tubular electrically conductive body having a radially compressible end, and a second RF connector that includes an electrically conductive housing having a passageway therethrough. The passageway may define a throat segment having a constant diameter equal to or larger than the radially compressible end of the first RF connector, and a contact ramp segment adjacent the throat segment and configured to compress the radially compressible end of the first RF connector. The contact ramp segment may have a progressively decreasing diameter defining a curvature. The passageway may also define a medial segment having a constant diameter equal to a diameter of an adjacent portion of the contact ramp segment, and a capture segment adjacent the medial segment having a diameter larger than the medial segment to removably capture the radially compressible end of the first RF connector. The RF connector assembly may further include a dielectric body carried by the housing, and an electrically conductive pin carried by the dielectric body and extending into the passageway. Accordingly, the RF connector assembly, for example, by way of the contact ramp segment may have a progressively decreasing diameter defining a curvature, which may reduce the creation of debris upon mating and thus provide increased electrical stability.

In some embodiments, the second RF connector may conform to MIL-STD-348 for a series SMP connector, such as for a series SMP full detent connector. In other embodiments, the second RF connector may conform to MIL-STD-348 for a series SMPM connector, such as for a series SMPM full detent connector.

A distal portion of the contact ramp segment may be linear in some embodiments, and distal portion may be curved. The opening in the housing may further define a sloped relief ramp segment between the medial segment and the capture segment. The tubular electrically conductive body of the first RF connector may have a pin-receiving passageway therein to receive the electrically conductive pin, for example.

The tubular electrically conductive body may have another radially compressible end opposite the radially compressible end, for example. The electrically conductive housing may include metal.

A method aspect is directed to making an RF connector for mating with another RF connector comprising a tubular electrically conductive body having a radially compressible end. The method may include forming an electrically conductive housing to have a passageway therethrough defining a throat segment having a constant diameter equal to or larger than the radially compressible end of the other RF connector, and a contact ramp segment adjacent the throat segment and configured to compress the radially compressible end of the other RF connector. The contact ramp segment may have a progressively decreasing diameter defining a curvature.

The passageway may also define a medial segment having a constant diameter equal to a diameter of an adjacent portion of the contact ramp segment, and a capture segment adjacent the medial segment having a diameter larger than the medial segment to removably capture the radially compressible end of the other RF connector. The method may also include positioning a dielectric body within electrically conductive housing and supporting an electrically conductive pin extending into the passageway.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
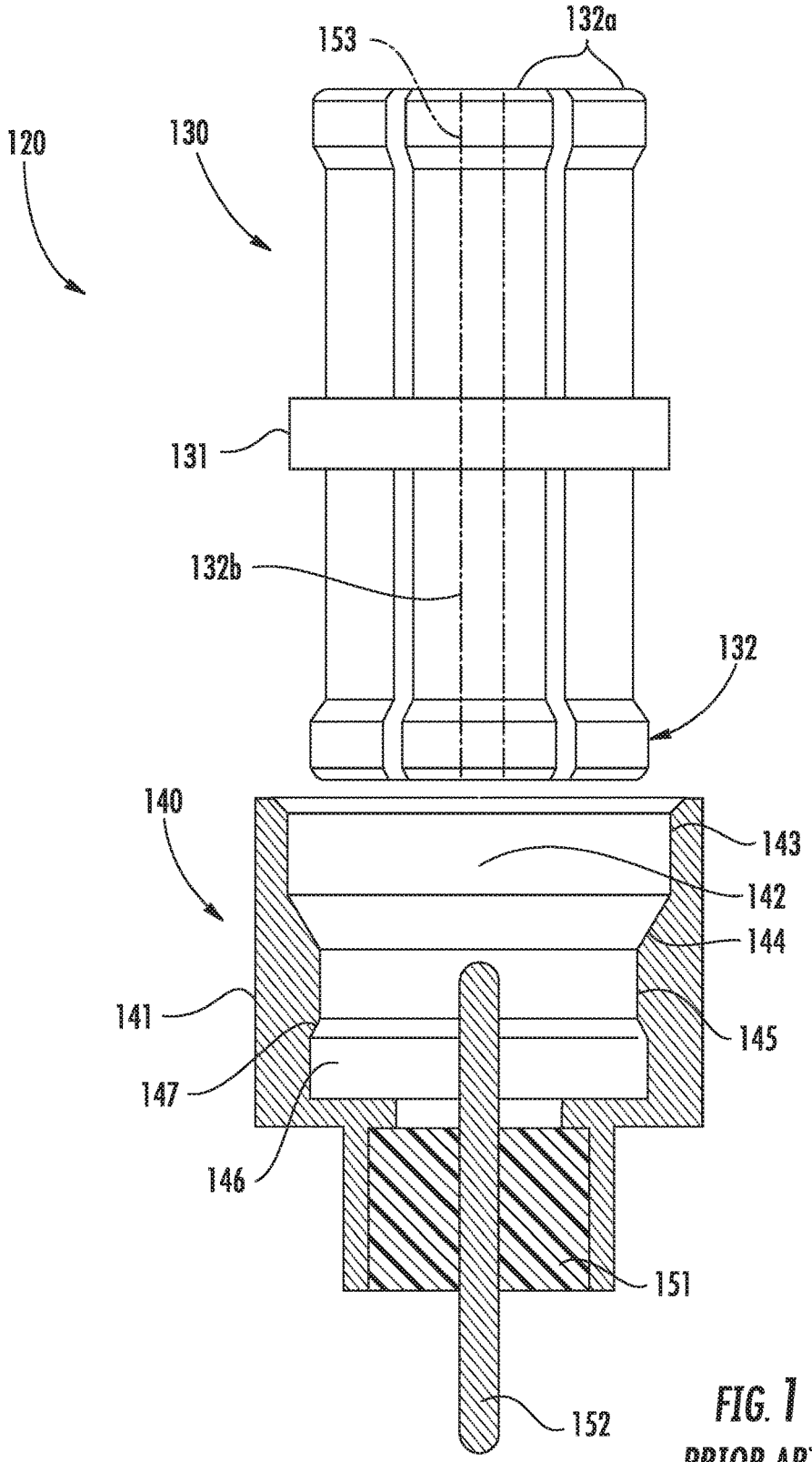
FIG. 1 PRIOR ART
FIG. 1 is a schematic side view of a radio frequency (RF) connector assembly in accordance with the prior art.
Figure 2:
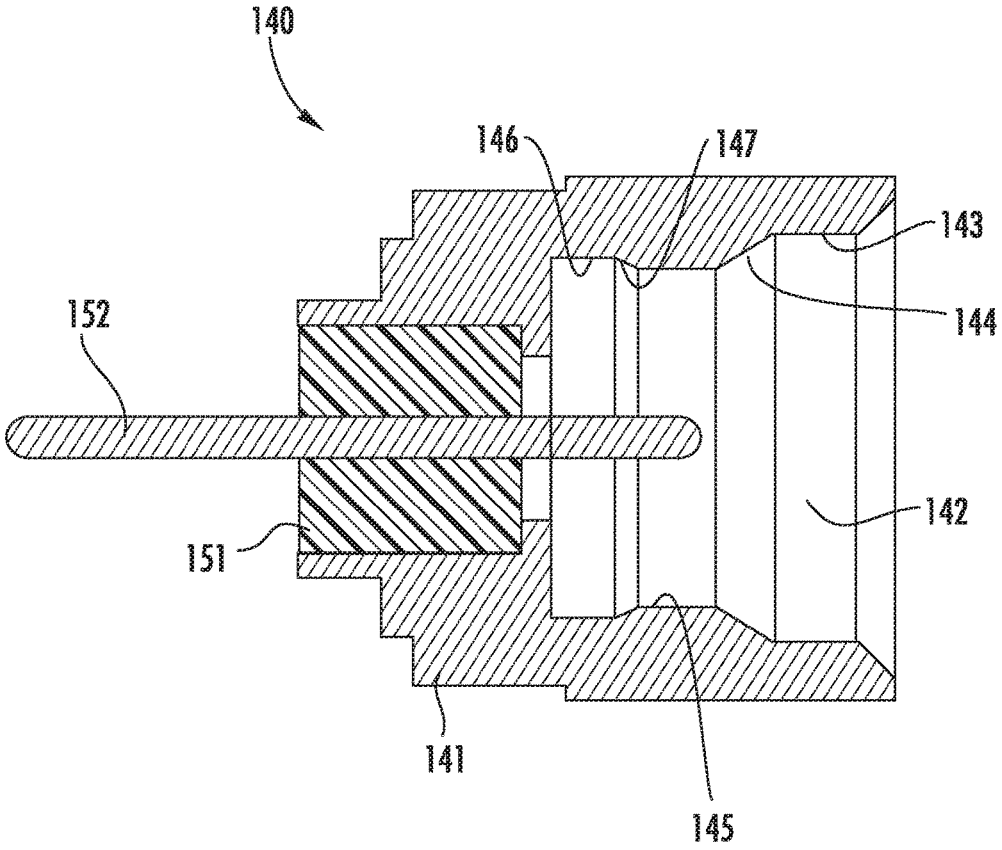
FIG. 2 PRIOR ART
FIG. 2 is a schematic cross-sectional view of the second RF connector of the RF connector assembly of FIG. 1.

Referring initially to FIGS. 1 and 2, a prior art radio frequency (RF) connector assembly 120, illustratively in the form of an SMP connector, includes a first RF connector 130 that includes a tubular electrically conductive body 131 that has a radially compressible distal end 132 defined by longitudinal end segments 132*b* with slots between adjacent end segments. In other words, the longitudinal end segments 132*b* may be in the form of compressible fingers or spring tines, as will be appreciated by those skilled in the art.

Similar longitudinal end segments 132*a* are provided at the opposite end in the illustrated embodiment. The electrically conductive body 131 may be metal, for example. The first RF connector 130 has a pin-receiving passageway 153 and defines a female-to-female RF connector.

A second RF connector 140 includes an electrically conductive housing 141, for example, comprising metal, that has a passageway 142 therethrough. The passageway 142 slidably receives the first RF connector 130 and defines a throat segment 143 that has a constant diameter typically larger than or equal to the radially compressible distal end 132 to thereby receive therein the radially compressible distal end of the first RF connector 130. A linearly sloped contact ramp segment 144 is adjacent the throat segment 143 and compresses the radially compressible distal end 132 of the first RF connector 130, for example, during insertion of the first RF connector into the passageway 142.

A medial segment 145 has a constant diameter equal to a diameter of an adjacent portion of the contact ramp segment 144. The contact ramp segment 144 has a linearly progressively decreasing diameter from adjacent the throat segment 143 to adjacent the medial segment 145 defining a linear ramp. In other words, the contact ramp segment 144 decrease in diameter is linear such that the transition between the contact ramp segment and the medial segment 145 defines a sharp transition.

A sloped relief ramp segment 147 is between the medial segment 145 and a capture segment 146. The sloped relief ramp segment 147 is illustratively linearly sloped, i.e., has no curvature.

The capture segment 146 is adjacent the medial segment 145 and has a diameter larger than the medial segment to removably capture the radially compressible distal end 132 of the first RF connector 130. In other words, the capture segment 146 defines a detent. When fully inserted within the passageway 142 of the housing 141, the radially compressible distal end 132 of the first RF connector 130 will expand from a more compressed position when adjacent the medial segment 145 to a less compressed position and be in electrical contact with the adjacent portions of the capture segment 146, and this arrangement will hold the connectors in the mated position.

The RF connector assembly 120 also includes a dielectric body 151 carried by the housing 141 and an electrically conductive pin 152 carried by the dielectric body and extending into the passageway 142. The electrically conductive pin 152 makes electrical contact in a pin-receiving passageway 153 within the first RF connector 130.

Figure 3:
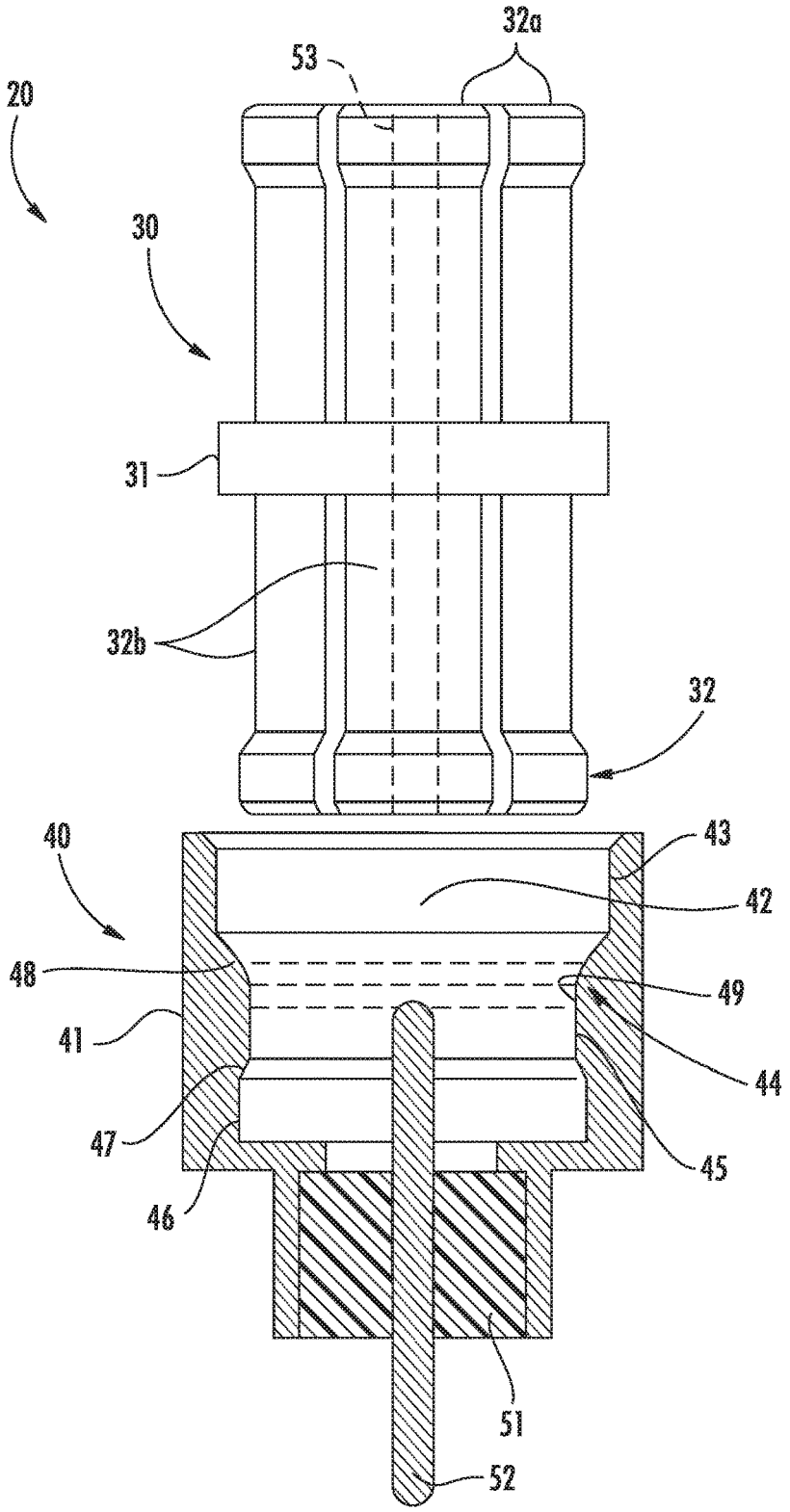
FIG. 3 is a schematic side view of an RF connector assembly in accordance with an embodiment.
Figure 4:
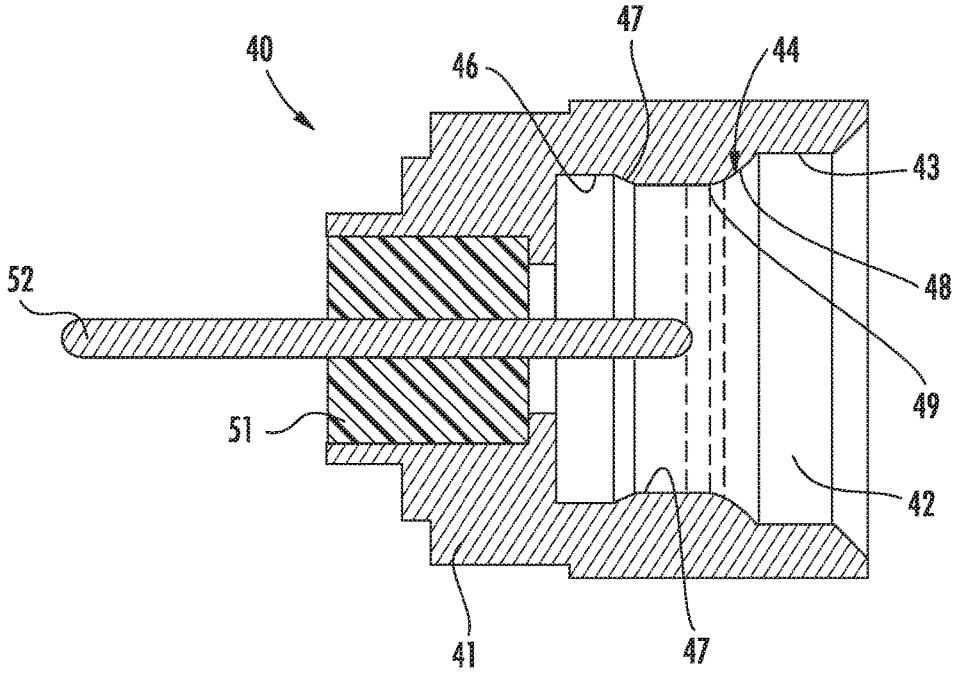
FIG. 4 is a schematic cross-sectional view of the second RF connector of the RF connector assembly of FIG. 3.
Figure 5:
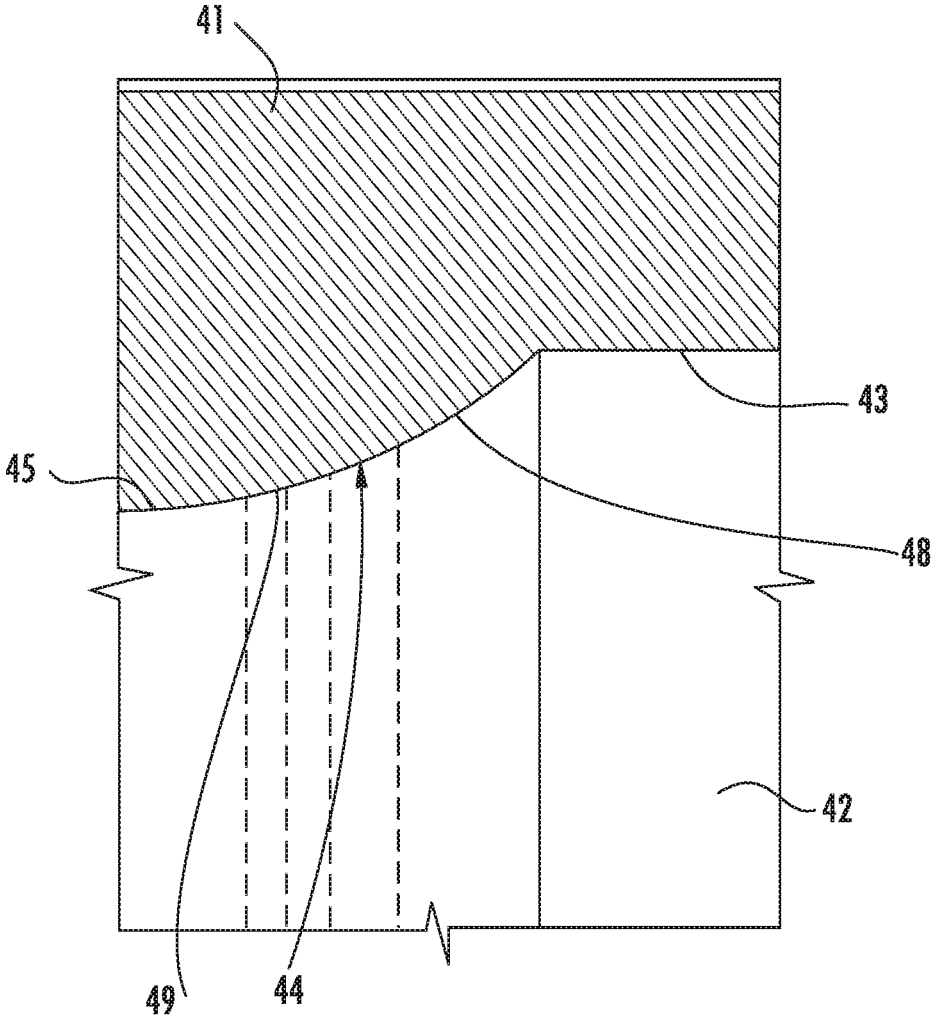
FIG. 5 is an enlarged cross-sectional view of a portion of the second RF connector of FIG. 4.

Referring now to FIGS. 3-5, an embodiment of an RF connector assembly 20 will now be described. The prior art approach described above with respect to FIG. 1 has several drawbacks. More particularly, the RF connector 120 assembly of the prior art has an increased amount of debris accumulation that may occur during mating and de-mating of the first and second RF connectors 130, 140 of the prior art RF connector assembly 120 (FIG. 1). The debris occurs, in part, as a result of surfaces, for example, metal, wearing against each other so that debris collects in the passageway 142 adjacent the capture segment 146. Since the first and second RF connectors 130, 140 are both electrically conductive, the debris is also electrically conductive, which may be detrimental for an electrical connector interface as it alters the electrical characteristics (e.g., ground path, impedance, etc.), as will be understood by those skilled in the art.

It has been determined that the majority of the debris described above is created by the linearity of the progressively decreasing diameter of the contact ramp segment 144 of the prior art connector. More particularly, the majority of the debris has been determined to be caused by the sharp transition between the contact ramp segment 144 and the medial segment 145. To address this increased debris, some prior art RF connector assembly manufacturers recommend spraying or using pressurized air to clean the RF connector assembly prior to mating the first and second RE connectors 130, 140.

The RF connector assembly 20 in accordance with the present embodiments advantageously reduces the amount of debris. The RF connector assembly 20 according to an embodiment is illustratively in the form of an SMP connector assembly and includes a first RF connector 30 that includes a tubular electrically conductive body 31 that has radially compressible distal end 32. The electrically conductive body 31 may be metal, for example. The longitudinal distal end segments 32*a*, 32*b* may be in the form of compressible fingers or spring tines, as will be appreciated by those skilled in the art. While an SMP connector is illustrated, it will be appreciated that the RF connector assembly may be another type of RF connector, for example, an SMPM connector, or other type of connector. For example, such exemplary connectors may be found in Department of Defense Interface Standard, MIL-STD-348B, the entire contents of which are hereby incorporated in their entirety by reference. The first RF connector 30 has a pin-receiving passageway 53 and defines a female-to-female RF connector.

A second RF connector 40 includes an electrically conductive housing 41, for example, metal, that has a passageway 42 therethrough. The material of the tubular electrically conductive body 31 and the material of the electrically conductive housing 41 may be chosen, for example, to achieve matching or compatible coefficients of thermal expansion (CTE), as will be appreciated by those skilled in the art. The passageway 42 slidably receives the first RF connector 30 and defines a throat segment 43 that has a constant diameter larger than or the same size as the radially compressible distal end 32 of the first RF connector 30. A contact ramp segment 44 is adjacent the throat segment 43 and compresses the radially compressible distal end 32 of the first RF connector 30, for example, during insertion of the first RF connector into the passageway 42.

A medial segment 45 has a constant diameter equal to a diameter of an adjacent portion of the contact ramp segment 44. The contact ramp segment 44 has a progressively decreasing diameter from adjacent the throat segment 43 to adjacent the medial segment 45 defining a curvature or curved ramp. In other words, the contact ramp segment 44 decrease in diameter is non-linear or curved such that the transition between the contact ramp segment and the medial segment 45 defines a relatively smooth transition relative to the prior art sharp transition described above. An example radius size for an SMP connector, for example, is about 0.035" and for an SMPM connector, about 0.020". To achieve these diameters, for example, the contact ramp segment 44 may have a distal linear portion 48 and a curved or rounded over proximal portion 49, for example, formed by a radius cut, as will be appreciated by those skilled in the art.

As will be appreciated by those skilled in the art, by turning the prior art sharp transition into a relatively smooth transition, or smooth radii, by replacing the linearly decreasing diameter contact ramp segment 144 with a non-linear or curved diameter contact ramp segment 44, the amount of accumulated debris may be significantly reduced, for example, upwards of 90%. Thus, the electrical characteristics of the RF connector assembly 20 may be maintained. It should be appreciated by those skilled in the art that there is little if any cost increase, for example, in machining, from a linear contact ramp segment 144 to a contact ramp segment 44 having a progressively decreasing diameter defining a curvature.

A sloped relief ramp segment 47 is between the medial segment 45 and a capture segment 46. The sloped relief ramp segment is illustratively linearly sloped, i.e., has no curvature.

A capture segment 46 is adjacent the medial segment 45 and has a diameter larger than the medial segment to removably capture the radially compressible distal end 32 of the first RF connector 30. When fully inserted within the passageway 42 of the housing 41, the radially compressible distal end 32 of the first RF connector 30 will expand from a more compressed position when adjacent the medial segment 45 to a less compressed position and be in electrical contact with the adjacent portions of the housing or the capture segment 46.

The RF connector assembly 20 also includes a dielectric body 51 carried by the housing 41 and an electrically conductive pin 52 carried by the dielectric body and extending into the passageway. The electrically conductive pin 52 makes electrical contact in a pin-receiving passageway within the first RF connector 30.

A method aspect is directed to a method of making an RF connector assembly 20 that includes a first RF connector 30 including a tubular electrically conductive body 31 having a radially compressible distal end 32*a*, 32*b*, a second RF connector 40 that includes an electrically conductive housing 41, a dielectric body 51 carried by the electrically conductive housing, and an electrically conductive pin 52 carried by the dielectric body. The method includes forming a passageway 42 through the housing defining a throat segment 43 having a constant diameter larger than the radially compressible distal end of the first RF connector, and a contact ramp segment 44 adjacent the throat segment and configured to compress the radially compressible distal end of the first RF connector. The contact ramp segment 44 has a progressively decreasing diameter defining a curvature. The method also includes forming the passageway 42 to define a medial segment 45 having a constant diameter equal to a diameter of an adjacent portion of the contact ramp segment, and a capture segment 46 adjacent the medial segment having a diameter larger than the medial segment to removably capture the radially compressible distal end of the first RF connector.

Figure 6:
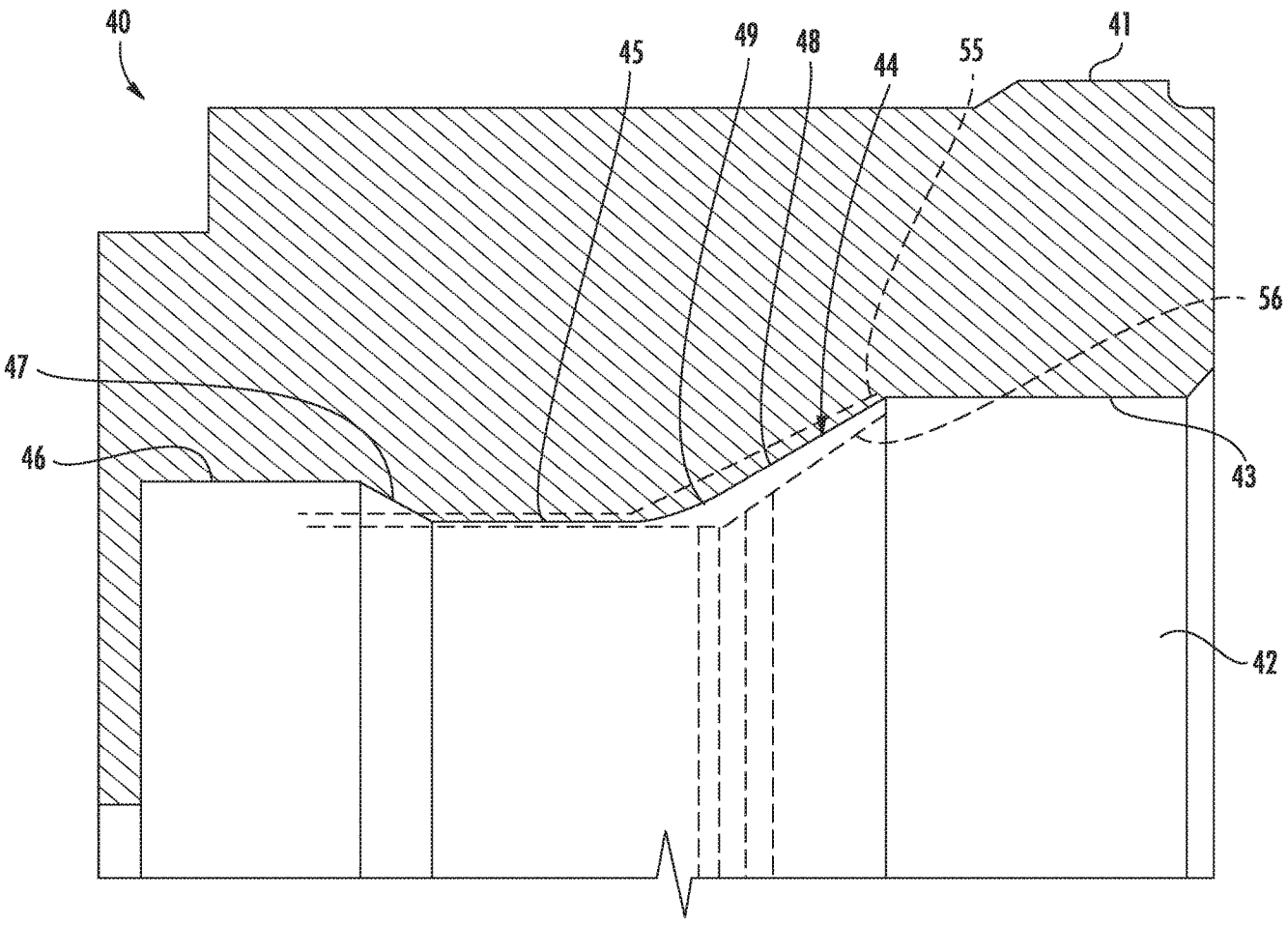
FIG. 6 is another enlarged cross-sectional view of a portion of the second RF connector of FIG. 4.

Turning now to FIG. 6, additional aspects of the connector 40 are explained. A dashed inner manufacturing tolerance line 55 and a dashed outer manufacturing tolerance line 56 are shown that bracket the actual curved surface of the contact ramp segment 44. These manufacturing tolerance lines 55, 56 are based upon an applicable connector standard. Accordingly, the sharp transition that may lead to debris accumulation is avoided by the curved surface of the contact ramp segment 44 that also fits within the tolerance range, yet the connector 40 still meets the respective manufacturing standard.

For example, the connector 40 may conforms to MIL-STD-348 for a series SMP connector, such as the series SMP full detent connector. In another example, the connector 40 may conform to MIL-STD-348 for a series SMPM connector, such as a series SMPM full detent connector, as will be appreciated by those skilled in the art. Those of skill in the art will also recognize that the curved contact ramp segment 44 may conform to other connector standards that provide a tolerance range to include a curved contact surface yet still comply with the standards.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A radio frequency (RF) connector assembly comprising:

a first RF connector comprising a tubular electrically conductive body having a radially compressible end;

a second RF connector comprising an electrically conductive housing having a passageway therethrough defining a throat segment having a constant diameter equal to or larger than said radially compressible end of said first RF connector, a contact ramp segment adjacent the throat segment and configured to compress the radially compressible end of said first RF connector, the contact ramp segment having a linear distal portion adjacent the throat segment and a curved proximal portion having a progressively decreasing diameter defining a curvature that is within dimensional tolerances of MIL-STD-348, a medial segment having a constant diameter equal to a diameter of the curved proximal portion of the contact ramp segment, and a capture segment adjacent the medial segment having a diameter larger than the medial segment to removably capture the radially compressible end of said first RF connector;

a dielectric body carried by said electrically conductive housing; and an electrically conductive pin carried by said dielectric body and extending into the passageway.

2. The RF connector assembly of claim 1 wherein said second RF connector conforms to the MIL-STD-348 for a series SMP connector.

3. The RF connector assembly of claim 1 wherein said second RF connector conforms to the MIL-STD-348 for a series SMP full detent connector.

4. The RF connector assembly of claim 1 wherein said second RF connector conforms to the MIL-STD-348 for a series SMPM connector.

5. The RF connector assembly of claim 1 wherein said second RF connector conforms to the MIL-STD-348 for a series SMPM full detent connector.

6. The RF connector assembly of claim 1 wherein the opening in said electrically conductive housing further defines a sloped relief ramp segment between the medial segment and the capture segment.

7. The RF connector assembly of claim 1 wherein said tubular electrically conductive body of said first RF connector has a pin-receiving passageway therein to receive said electrically conductive pin.

8. The RF connector assembly of claim 1 wherein said tubular electrically conductive body has a radially compressible other end opposite the radially compressible end.

9. The RF connector assembly of claim 1 wherein said electrically conductive housing comprises metal.

10. A radio frequency (RF) connector for mating with another RF connector comprising a tubular electrically conductive body having a radially compressible end, the RF connector comprising:

an electrically conductive housing having a passageway therethrough defining a throat segment having a constant diameter equal to or larger than the radially compressible end of the other RF connector, a contact ramp segment adjacent the throat segment and configured to compress the radially compressible end of the other RF connector, the contact ramp segment having a linear distal portion adjacent the throat segment and a curved proximal portion having a progressively decreasing diameter defining a curvature that is within dimensional tolerances of MIL-STD-348, a medial segment having a constant diameter equal to a diameter of the curved proximal portion of the contact ramp segment, and a capture segment adjacent the medial segment having a diameter larger than the medial segment to removably capture the radially compressible end of the other RF connector;

a dielectric body carried by said electrically conductive housing; and an electrically conductive pin carried by said dielectric body and extending into the passageway.

11. The RF connector of claim 10 wherein said electrically conductive housing, dielectric body and electrically conductive pin conform to the MIL-STD-348 for a series SMP connector.

12. The RF connector of claim 10 wherein said electrically conductive housing, dielectric body and electrically conductive pin conform to the MIL-STD-348 for a series SMP full detent connector.

13. The RF connector of claim 10 wherein said electrically conductive housing, dielectric body and electrically conductive pin conform to the MIL-STD-348 for a series SMPM connector.

14. The RF connector of claim 10 wherein said electrically conductive housing, dielectric body and electrically conductive pin conform to the MIL-STD-348 for a series SMPM full detent connector.

15. The RF connector of claim 10 wherein the opening in said electrically conductive housing further defines a sloped relief ramp segment between the medial segment and the capture segment.

16. The RF connector of claim 10 wherein said electrically conductive housing comprises metal.

17. A method for making a radio frequency (RF) connector for mating with another RF connector comprising a tubular electrically conductive body having a radially compressible end, the method comprising:

forming an electrically conductive housing to have a passageway therethrough defining a throat segment having a constant diameter equal to or larger than the radially compressible end of the other RF connector, a contact ramp segment adjacent the throat segment and configured to compress the radially compressible end of the other RF connector, the contact ramp segment having a linear distal portion adjacent the throat segment and a curved proximal portion having a progressively decreasing diameter defining a curvature that is within dimensional tolerances of MIL-STD-348, a medial segment having a constant diameter equal to a diameter of the curved proximal portion of the contact ramp segment, and a capture segment adjacent the medial segment having a diameter larger than the medial segment to removably capture the radially compressible end of the other RF connector; and positioning a dielectric body within electrically conductive housing and supporting an electrically conductive pin extending into the passageway.

18. The method of claim 17 wherein the electrically conductive housing, dielectric body and electrically conductive pin conform to the MIL-STD-348 for a series SMP connector.

19. The method of claim 17 wherein the electrically conductive housing, dielectric body and electrically conductive pin conform to the MIL-STD-348 for a series SMP full detent connector.

20. The method of claim 17 wherein the electrically conductive housing, dielectric body and electrically conductive pin conform to the MIL-STD-348 for a series SMPM connector.

21. The method of claim 17 wherein the electrically conductive housing, dielectric body and electrically conductive pin conform to the MIL-STD-348 for a series SMPM full detent connector.

22. The method of claim 17 wherein the opening in the electrically conductive housing further defines a sloped relief ramp segment between the medial segment and the capture segment.

23. The method of claim 17 wherein the electrically conductive housing comprises metal.

* * * * *